United States Patent [19]

Vasalos

[11] Patent Number: 4,511,434

[45] Date of Patent: Apr. 16, 1985

[54] FLUID BED RETORTING SYSTEM

[75] Inventor: Iacovos Vasalos, Downers Grove, Ill.

[73] Assignee: Standard Oil Company (Indiana), Chicago, Ill.

[21] Appl. No.: 423,663

[22] Filed: Sep. 27, 1982

Related U.S. Application Data

[63] Continuation-in-part of Ser. No. 293,694, Aug. 17, 1981, Pat. No. 4,404,083.

[51] Int. Cl.[3] ..... B01J 8/30; B01J 8/32; C10B 49/22

[52] U.S. Cl. ..... 202/99; 422/140; 422/142; 422/144

[58] Field of Search ..... 208/8 R, 11 R; 201/31; 202/99, 215; 422/142–145, 147, 140

[56] References Cited

U.S. PATENT DOCUMENTS

| | | | |
|---|---|---|---|
| 3,412,013 | 11/1968 | Bowles | 422/144 |
| 3,501,394 | 3/1970 | Lyons | 208/11 R |
| 3,844,929 | 10/1974 | Wunderlich et al. | 208/11 R |
| 4,057,397 | 11/1977 | Gross et al. | 422/144 |
| 4,125,453 | 11/1978 | Tamm et al. | 201/31 |
| 4,211,606 | 7/1980 | Ponomarev et al. | 208/11 R |
| 4,283,273 | 8/1981 | Owen | 422/144 |
| 4,415,433 | 11/1983 | Hoekstra | 201/31 |

FOREIGN PATENT DOCUMENTS 2526839 1/1976 Fed. Rep. of Germany .

*Primary Examiner*—Bradley Garris

*Attorney, Agent, or Firm*—Thomas W. Tolpin; William T. McClain; William H. Magidson

[57] ABSTRACT

A fluid bed system for retorting solid hydrocarbon-containing material, such as oil shale, coal and tar sands, in which solid hydrocarbon-containing material and heat carrier material are fed into a mixing chamber, mixed and rapidly transported upwardly by a lift gas through a lift pipe into a solids-containing vessel to retort the hydrocarbon-containing material with minimal thermal cracking of the liberated hydrocarbons to increase the recovery of condensable hydrocarbons. The retorted material can be conveyed to a dilute phase lift pipe and combustor vessel where carbon residue in the retorted material is combusted leaving hot spent material that can be fed into the mixing chamber as solid heat carrier material.

17 Claims, 2 Drawing Figures

FLUID BED RETORTING SYSTEM

CROSS-REFERENCES TO RELATED APPLICATIONS

This application is a continuation-in-part of U.S. patent application, Ser. No. 293,694, filed Aug. 17, 1981, now U.S. Pat. No. 4,404,083, for a Fluid Bed Retorting Process and System.

BACKGROUND OF THE INVENTION

This invention relates to a system for retorting hydrocarbon-containing material, and more particularly, to a fluid bed system for retorting solid, hydrocarbon-containing material such as oil shale, coal and tar sands.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the U.S. with almost sixty percent located in the rich Green River oil shale deposits of Colorado, Utah, and Wyoming. The remainder is contained in the leaner Devonian-Mississippian black shale deposits which underlie most of the eastern part of the United States As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In order to obtain high thermal efficiency in retorting, carbonate decomposition should be minimized. Colorado Mahongany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

In surface retorting, oil shale is mined from the ground, brought to the surface, crushed and placed in vessels where it is contacted with a hot heat transfer carrier, such as hot spent shale, sand or gases, or mixtures thereof, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The liberated hydrocarbons and combustion gases are dedusted in electrostatic precipitators, filters, scrubbers, pebble beds, by dilution and centrifuging, or in a cyclone such as shown in U.S. Pat. Nos. 3,252,886; 3,784,462 and 4,101,412.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

Directly heated surface retorting processes, such as the N-T-U, Kiviter, Fusham and gas combustion processes, rely upon the combustion of fuel, such as recycled gas or residual carbon in the spent shale, with air or oxygen within the bed of shale in the retort to provide sufficient heat for retorting. Directly heated surface retorting processes usually result in lower product yields due to unavoidable combustion of some of the products and dilution of the product stream with the products of combustion. The Fusham process is shown and described at pages 101–102, in the book *Oil Shales and Shale Oils,* by H. S. Bell, published by D. Van Norstrand Company (1948). The other processes are shown and described in the *Synthetic Fuels Data Handbook,* by Cameron Engineers, Inc. (second edition, 1978).

Indirectly heated surface retorting processes, such as the Petrosix, Lurgi-Ruhrgas, Tosco II and Galoter processes, utilize a separate furnace for heating solid or gaseous heat-carrying material which is injected, while hot, into the shale in the retort to provide sufficient heat for retorting. In the Lurgi-Ruhrgas process and some other indirect heating processes, raw oil shale or tar sands and a hot heat carrier, such as spent shale or sand, are mechanically mixed and retorted in a screw conveyor. Such mechanical mixing often results in high temperature zones conducive to undesirable thermal cracking as well as causing low temperature zones which result in incomplete retorting. Furthermore, in such processes, the solids gravitate to the lower portion of the vessel, stripping the retorted shale with gas causing lower product yields due to reabsorption of a portion of the evolved hydrocarbons by the retorted solids. Generally, indirect heating surface retorting processes result in higher yields and less dilution of the retorting product than directly heated surface retorting processes, but at the expense of additional materials handling.

Surface retorting processes with a moving bed are typified by the Lurgi coal gasification process in which crushed coal is fed into the top of a moving bed gasification zone and upflowing steam endothermically reacts with the coal. A portion of the char combusts with oxygen below the gasification reaction zone to supply the required endothermic heat of reaction. Moving bed processes are disadvantageous because the solids residence time is usually long, necessitating either a very large contacting or reaction zone or a large number of reactors. Moreover, moving bed processes often cannot tolerate excessive amounts of fines.

Surface retorting processes with entrained beds are typified by the Koppers-Totzek coal process in which coal is dried, finely pulverized and injected into a treatment zone along with steam and oxygen. The coal is rapidly partially combusted, gasified, and entrained by the hot gases. Residence time of the coal in the reaction zone is only a few seconds. Entrained bed processes are disadvantageous because they require large quantities of hot gases to rapidly heat the solids and often require the raw feed material to be finely pulverized before processing.

Fluid bed surface retorting processes are particularly advantageous. The use of fluidized-bed contacting zones has long been known in the art and has been widely used in fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is know as the "minimum fluidization velocity." The velocity of the fluid at which the solid becomes entrained in the fluid is known as the "terminal velocity" or "entrainment velocity." Between the minimum fluidization velocity and the terminal velocity, the bed of solids is in a fluidized state and it exhibits the appearance and some of the characteristics of a boiling liquid. Because of the quasi-fluid or liquid-like state of the solids, there is typically a rapid overall circulation of all the solids throughout the entire bed with substantially complete mixing, as in a stirred-tank reaction system. The rapid circulation is particularly advantageous in processes in which a uniform temperature and reaction mixture are desired throughout the contacting zone.

Typifying those prior art fluidized bed retorting processes, fluid catalytic cracking processes, and similar processes are the Union Carbide/Battelle coal gasification process, the fluid coker and flexicoking processes described at page 300 of the *Synthetic Fuels Data Handbook*, by Cameron Engineers, Inc. (second edition, 1978) and those found in U.S. Pat. Nos. 2,471,119; 2,506,307; 2,518,693; 2,608,526; 2,657,124; 2,684,931; 2,793,104; 2,799,359; 2,807,571; 2,844,525; 3,039,955; 3,152,245; 3,281,349; 3,297,562; 3,501,394; 3,617,468; 3,663,421; 3,703,052; 3,803,021; 3,803,022; 3,855,070; 3,976,558; 3,980,439; 4,052,172; 4,064,018; 4,087,347; 4,110,193; 4,125,453; 4,133,739; 4,137,053; 4,141,794; 4,148,710; 4,152,245; 4,157,245; 4,183,800; 4,199,432. These prior art processes have met the varying degrees of success.

Prior art gas fluidized bed processes usually have a dense particulate phase and a bubble phase, with bubbles forming at or near the bottom of the bed. These bubbles generally grow by coalescence as they rise through the bed. Mixing and mass transfer are enhanced when the bubbles are small and evenly distributed throughout the bed. When too many bubbles coalesce so that large bubbles are formed, a surging or pounding action results, leading to less efficient heat and mass transfer.

A problem with many prior art fluidized bed processes is the long residence time at high temperatures which results in many secondary and undesirable side reactions such as thermal cracking, which usually increases the production of less desirable gaseous products and decreases the yield and quality of desirable condensable products. Therefore, in any process designed to produce the maximum yield of high quality condensable hydrocarbons, it is preferred that the volatilized hydrocarbons are quickly removed from the retorting vessel in order to minimize deleterious side reactions such as thermal cracking.

Another problem with many prior art processes, particularly with countercurrent fluidized bed flow processes, is that after the shale oil has been vaporized, it then comes in contact with countercurrent flowing solids which are at a much cooler temperature, which leads to condensation of a portion of the shale oil and reabsorption of a portion of the vaporized shale oil into the downward flowing shale. This condensation and reabsorption leads to coking, cracking and polymerization reactions, all of which are detrimental to producing the maximum yield of condensable hydrocarbons.

It is therefore desirable to provide an improved fluid bed retorting process and system which overcomes most, if not all, of the preceding problems.

SUMMARY OF THE INVENTION

A fluid bed retorting system is provided which minimizes thermal cracking of liberated hydrocarbons during retorting to maximize the yield of condensable hydrocarbons. The novel system is particularly useful in producing synthetic fuels from oil shale, coal and tar sands because it avoids the use of most equipment and machinery with complex moving parts whose throughput capacity is typically limited and which have a tendency to clog, break down or malfunction.

In the novel system, raw fluidizable, retortable, solid hydrocarbon-containing material, such as oil shale, coal or tar sands, is mixed with hot fluidizable, solid, heat carrier material, such as spent shale or sand, in a mixing chamber and rapidly transported upwardly through a lift pipe into a solids-containing vessel. Retorting of the raw hydrocarbon-containing material commences in the mixing chamber, continues in the lift pipe and is completed in the solids-containing vessel with minimal thermal cracking of the liberated hydrocarbons. The retorting temperature is selected by introducing the heat carrier material into the mixing chamber at a temperature sufficient to liberate hydrocarbons contained in the raw hydrocarbon-containing material with minimal carbonate decomposition. The retorting residence time is controlled by injecting a lift gas into the mixing chamber at a flow rate and pressure to fluidize, entrain, and rapidly transport the admixture through the mixing chamber and lift pipe with minimal thermal cracking of the liberated hydrocarbons. The fluidized admixture gravitates downwardly to a solids discharge outlet for a sufficient residence time in the solids-containing vessel to complete retorting of the raw hydrocarbon-containing material without thermal cracking a substantial amount of the liberated hydrocarbons.

The retorted hydrocarbon-containing material and the heat carrier material are discharged from the solids discharge outlet and the liberated hydrocarbons and the lift gas are withdrawn from an upper portion of the solids-containing vessel for further processing or recycling. Some of the discharged light hydrocarbon gases can be recycled for use as the lift gas. Combusted, retorted, hydrocarbon-containing material, such as spent shale or sand can be used as the heat carrier material.

In the preferred system for carrying out the retorting process, the mixing chamber has a cross-sectional area substantially greater than the cross-sectional area of the lift pipe, taken in a direction transverse to the upward flow of lift gas and the solid raw hydrocarbon-containing material and hot heat carrier material are separately fed through separate feed lines into the mixing chamber.

As used throughout this application, the term "retorted" hydrocarbon-containing material or "retorted" shale refers to hydrocarbon-containing material or oil shale, respectively, which has been retorted to liberate hydrocarbons leaving a material containing carbon residue.

The term "spent" hydrocarbon-containing material or "spent" shale as used herein means retorted hydrocarbon-containing material or shale, respectively, from which most, if not all, of the carbon residue has been removed by combustion.

The terms "condensable," "condensed," "noncondensable," "normally gaseous" or "normally liquid" are relative to the condition of the subject material at a temperature of 77° F. (25° C.) and a pressure of one atmosphere.

A more detailed explanation of the invention is provided in the following description and appended claims taken in conjunction with the accompanying drawings.

DETAILED DESCRIPTION OF THE PREFERRED EMBODIMENT

Figures 1, 2:
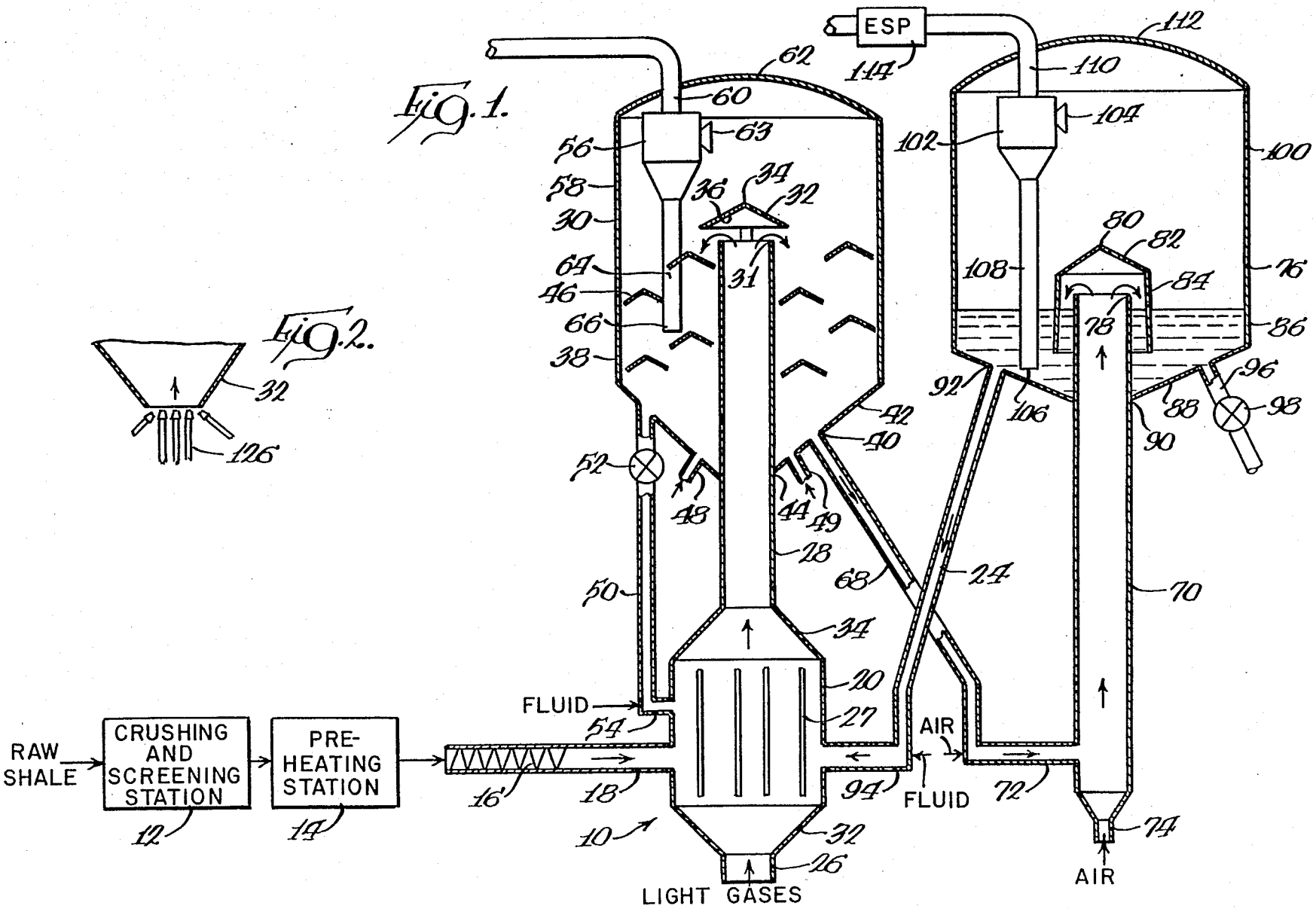
FIG. 1 is a schematic flow diagram of a fluid bed retorting system in accordance with principles of the present invention.
FIG. 2 is a cross-sectional view of injector nozzles for use in the fluid bed retorting system.

Referring now to FIG. 1, a fluid bed process and system 10 is provided to retort hydrocarbon-containing material, such as oil shale, coal, tar sands, diatomaceous earth, uintaite (gilsonite), lignite and peat, for use in making synthetic fuels. The process and system are also referred to as a short contact time process and system. While the process of the present invention is described hereinafter with particular reference to the processing of oil shale, it will be apparent that the process can also be used to retort other hydrocarbon-containing materials such as coal, tar sands, diatomaceous earth, uintaite (gilsonite), lignite, peat, etc.

In process and system 10, raw oil shale is fed to a crushing and screening station 12. The oil shale should contain an oil yield of at least 15 gallons per ton of shale particles in order to make the process and system self-sustaining in terms of energy requirements, so that the lift gas consists esssentially of liberated light hydrocarbons from the system and the heat carrier material consists essentially of spent oil shale from the system.

At the crushing and screening station 12, raw oil shale is crushed and sized to a maximum particle size of 6 mm, so as to be fluidizable, by conventional crushing equipment such as a jaw crusher, gyratory crusher or roll crusher and by conventional screening equipment such as a shaker screen or vibrating screen. Oil shale particles over 6 mm should be avoided, if possible, because they do not attain the desired lift velocity for effective retorting.

The crushed oil shale particles are conveyed to a preheating station 14 where the shale is preheated to between ambient temperature and 700° F. to dry off most of the moisture contained in the shale. Preferably, the crushed oil shale particles are preheated to a temperature from 250° to 600° F., and most preferably, from 300° to 400° F. Oil shale temperatures over 700° F. should be avoided at this stage because they may cause premature retorting. The preheating station 14 and the crushing and screening station 12 can be combined, if desired.

The preheated, crushed oil shale particles are conveyed by a screw conveyor 16 or other conveying means such as a lift elevator, gravity flow from a lock hopper or conventional fluid conveying means, through a feed pipe 18 into a mixing chamber 20, which is sometimes referred to as an "ejector" or "mixing zone." The crushed oil shale particles are fed into mixing chamber 20 at a solids flux flow rate between 500 to 100,000 lbs/ft$^2$ hr, and preferably between 2,500 to 10,000 lbs/ft$^2$ hr. A solids flux flow rate over 100,000 lbs/ft$^2$ hr should be avoided because retorting efficiency is reduced.

Heat carrier material, preferably, spent oil shale from the system having a particle size similar to the oil shale particles so as to be fluidizable, is fed through a heat carrier pipe 24 into mixing chamber 20 at a temperature from 1000° F. to 1400° F., preferably from 1100° F. to 1300° F., and, most preferably, from 1150° to 1250° F. Heat carrier material in excess of 1400° F. should not be fed into the mixing chamber because it will decompose substantial quantities of carbonates in the oil shale. Heat carrier material below 1000° F. should not be fed into the mixing chamber, if possible, because fine removal problems are aggravated and heat carrier input requirements are increased because of the high attrition rates at high recycle ratios.

The ratio of the solids flux flow rate of the heat carrier material (spent shale) being introduced into mixing chamber 20 to the solids flux flow rate of raw shale in lbs/ft$^2$ hr is in the range of from 2.5:1 to 10:1, and preferably, from 4:1 to 5:1.

The influent rate of the raw oil shale particles and spent shale being fed into mixing chamber 20 is sufficient to mix the oil shale particles and spent shale together in the mixing chamber so that the hot spent shale directly contacts and heats the raw oil shale particles to commence partial retorting of the raw oil shale particles in mixing chamber 20. The hydrocarbons liberated during retorting are emitted as a gas, vapor, mist or liquid droplets and most likely, a mixture thereof. A series of vertical metal bars 27 or horizontial screens can also be positioned in the interior of mixing chamber 20 to promote mixing and heat transfer as well as to break bubbles and reduce slugging that may result during retorting.

A fluidizing lift gas, such as recycled light hydrocarbon gases from the system, is injected by a lift gas injector or gas tube 26 into the bottom of mixing chamber 20 at a temperature between ambient temperature and 1000° F., preferably from 500° F. to 700° F., at a pressure from 30 to 100 psig, preferably at a maximum of 40 psig, and at a velocity of from 30 ft/sec to 200 ft/sec, preferably at a maximum of 100 ft/sec. A lift gas injection velocity of over 200 ft/sec should be avoided because it has a tendency to break apart the oil shale particles. A lift gas injection velocity below 30 ft/sec will not provide enough lift for the oil shale particles. The life gas should not contain a sufficient amount of molecular oxygen to support combustion. In other words, a molecular oxygen, combustion-supporting gas, such as air, should be avoided as a lift gas in the mixing chamber because it could undesirably combust liberated oil in the mixing chamber as well as in lift pipe 28 and solids-containing vessel 30.

In the preferred embodiment, the lift gas is supplied by recycled, light hydrocarbon gases that have been discharged from the fluidized bed-containing vessel 30 and contains carbon dioxide, hydrogen, methane, $C_2$ and other light hydrocarbons. Preferably, the lift gas contains 10 to 40% $CO_2$ and most preferably, between 20 to 30% $CO_2$. At least 10% carbon dioxide is needed to effectively suppress carbonate decomposition in the retorting process.

Combustion of the raw oil shale particles and liberated hydrocarbons is prevented in mixing chamber 20 and lift pipe 28 by preventing an amount of molecular oxygen sufficient to support combustion from entering the mixing chamber and lift pipe.

The injection pressure and flow rate of the lift gas into mixing chamber 20 is sufficient to enhance turbulent mixing of the raw oil shale particles and spent shale as well as to fluidize, entrain, propel and convey the admixture and liberated hydrocarbons upwardly through the mixing chamber 20 and a vertical lift pipe 28 into an upper solids-containing collection vessel 30. The superficial upward velocity of the lift gas in mixing chamber 20 is in the range from 2.0 ft/sec to 4.5 ft/sec, preferably from 3.5 ft/sec to 4 ft/sec. The retorting temperature in the mixing chamber is in the range from 900° F. to 1200° F., preferably from 975° F. to 1050° F., and most preferably at 1025° F. The retorting pressure in the mixing chamber is from 30 psig to 50 psig and preferably at a maximum of 40 psig. The retorting temperature and pressure in the mixing chamber are generally uniform, except in proximity to the inlets and outlets.

The solids residence time of the raw oil shale particles and spent shale in mixing chamber 20 is in the range from 10 to 100 seconds. The gas residence time of the lift gas and liberated hydrocarbons in mixing chamber 20 is between 0.5 and 5.0 seconds, and preferably at a maximum of 2.5 seconds. A solids residence time of over 100 seconds in the mixing chamber 20 causes an undesirable amount of cracking of the liberated hydrocarbons. A solids residence time of less than 20 seconds in the mixing chamber is too short for effective retorting.

In order to enhance mixing, retorting, entrainment and throughput while minimizing thermal cracking of the liberated hydrocarbons, mixing chamber 20 has a maximum cross-sectional area substantially greater than the maximum cross-sectional area of lift pipe 28 taken in a widthwise (horizontal) direction, transverse to the upward flow of lift gas. Preferably, the ratio of the maximum cross-sectional areas of mixing chamber 20 to lift pipe 28 is from 1.3:1 to 15:1, and most preferably about 3:1. The ratio of the height (length) of mixing chamber 20 to the diameter of mixing chamber 20 is from 1:1 to 10:1. Mixing chamber 20 preferably has an upwardly diverging, frustro-conical wall portion 32 adjacent lift gas injector tube 26 and an upwardly converging frustro-conical wall portion 34 adjacent lift pipe 28 to attain a more uniform flow pattern and pressure change.

The ratio of the cross-sectional area of mixing chamber 20 to the total cross-sectional area of the lift gas injector tube 26, taken in a widthwise (horizontal) direction transverse to the upward flow of lift gas is from 2.5:1 to 20:1, and preferably 5:1.

Lift pipe 28, which is sometimes referred to as a "vertical riser reactor," extends into the solids-containing vessel 30. The upward velocity of the lift gas and liberated hydrocarbons in lift pipe 28 is in the range from 20 ft/sec to 100 ft/sec, preferably 30 ft/sec to 50 ft/sec, and most preferably at least 40 ft/sec to transport the raw oil shale particles. The gas residence time of the lift gas and liberated hydrocarbons in lift pipe 28 is in the range from 1 second to 5 seconds and preferably at a maximum of 3 seconds. The density of the solids admixture in lift pipe 28 is in the range from 3 lbs/ft$^3$ to 20 lbs/ft$^3$ and preferably from 5 lbs/ft$^3$ to 10 lbs/ft$^3$.

The bottom 42 of the solids-containing vessel is welded or otherwise secured to the middle portion of lift pipe 28. Solids-containing vessel 30 has a centrally disposed, lift pipe-receiving opening 44 at its bottom end to permit the lift pipe 28 to extend upwardly into the solids-containing vessel 30. The ratio of the maximum cross-sectional area of the solids-containing vessel 30 to the maximum cross-sectional area of mixing chamber 20 taken in a horizontal direction is in the range of 2:1 to 10:1, and preferably 5:1.

The upper free-standing, unattached outlet 31 of lift pipe 28 is spaced slightly below a conical baffle 32 whose apex 34 is in axial alignment with the vertical axis of lift pipe 28. The downwardly facing surfaces 36 of conical baffle 32 direct and deflect the solids admixture as well as the lift gas and liberated hydrocarbons downwardly towards the lower portion 38 of the solids-containing vessel 30.

The solids admixture moves downwardly by gravity flow in the lower portion 38 of vessel 30 for a sufficient residence time to complete retorting of the raw oil shale particles. The solids residence time of the oil shale particles and spent shale in the solids-containing vessel 30 is from 1 to 20 minutes, and preferably at a maximum of 3 minutes to attain the desired results. The downwardly converging, sloping bottom wall 42 of vessel 30 facilitates downward flow of the solids admixture to solids discharge outlet 40.

An array of conical baffles 46 is staggered in the lower portion 38 of vessel 30 to facilitate downward plug flow and minimize backflow of the solids admixture in the lower portion 38 of vessel 30. The underside of the conical baffles 46 provides an upward barrier against backflow. The top surfaces of the conical baffles 46 slope downwardly to direct the solid agglomerates downwardly to minimize the formation of clusters.

Steam injectors 48 and 49 can be provided to inject steam into the bottom 42 of the solids-containing vessel 30 to partially fluidize the solids admixture and enhance downward plug flow. The steam causes staged, downward flow of the solids admixture in the vessel's lower portion 38 to provide a staged fluidized bed. The upward velocity of the steam injected into vessel 30 is from 0.2 ft/sec to 3 ft/sec, and preferably at a maximum of 2 ft/sec. Conical baffles 46 help break up bubbles that may be emitted during the injection of steam at high rates.

An optional return pipe 50 extends downward from the lower portion 38 of vessel 30 to mixing chamber 20 for return of the solids admixture for further retorting, if desired. The outlet end of return pipe 50 has an L valve 54 into which a fluid can be injected to help transport the returned solids into mixing chamber 20. Shutoff valve 52 regulates the return flow of the solids through return pipe 50.

The effluent product stream of liberated hydrocarbons admixed with lift gas and steam rises to the upper portion 58 of the solids-containing vessel 30 and is dedusted by dedusting equipment, such as cyclones. In the preferred embodiment, 8 sets of cyclones 56 are positioned within the interior of the upper portion 58 of the vessel 30 to dedust the product effluent stream, lift gas and steam before being withdrawn and discharged through a gas outlet 60 located along the rounded, concave top 62 of vessel 30. Each of the cyclones 56 has an upper gas inlet 63 that receives liberated hydrocarbons, lift gas and steam contained in the upper portion 58 of vessel 30, and has a cyclone riser pipe 64 which extends downwardly into the solids-containing vessel and terminates in a lower gas inlet 66 for inflow of influent liberated hydrocarbons and steam contained in the lower portion 38 of vessel 30. While cyclones 56 are preferably located within the interior of vessel 30, it may be desirable in some circumstances to position the cyclones outside of vessel 30. The liberated hydrocarbons, lift gas and steam withdrawn from vessel 30 are processed downstream by means well known in the art, such as in a fractionating column (fractionator), quench tower, condenser or scrubber or multiples thereof to separate the heavy, middle and light oils and gases for subsequent upgrading in a catalytic cracker or hydrotreater. In the preferred embodiment, at least some of the light gases are recycled into the lift gas injector pipe 26 for use as part or all of the lift gas.

The retorted oil shale particles and the heat carrier material are discharged through solids discharge outlet 40 at the bottom of the solids-containing vessel 30 and are conveyed through a solids discharge pipe 68 by gravity flow into the bottom inlet end of an upright, dilute phase combustor lift pipe 70. The lower end of solids discharge pipe 68 has an L valve 72 through which air can be injected to help transport the discharged, retorted oil shale particles and heat carrier material into combustor lift pipe 70.

Air is injected into the bottom of combustor lift pipe 70 through air injector inlet 74 at a pressure from 20 to 80 psig, preferably from 30 to 40 psig, and at an upward velocity of 20 to 75 ft/sec., preferably from 30 to 50 ft/sec, to fluidize, entrain, and convey the discharged, retorted oil shale particles and heat carrier material upwardly through combustor lift pipe 70 into a combustor vessel 76. The temperature in combustor lift pipe 70 is from 1000° F. to 1400° F. and the residence time of the retorted oil shale particles, heat carrier material and air in combustor lift pipe 70 is from 2 to 10 seconds and preferably from 5 to 8 seconds. The carbon residue contained in the retorted oil shale particles is partially combusted in combustor lift pipe 70.

Combustor lift pipe 70 extends upwardly into the interior of combustor vessel 76 and has an outlet 78 at its top end positioned slightly below a conical baffle 80. Baffle 80 has downwardly diverging wall portion 82 as well as an optional annular skirt 84 to defect and direct the flow of retorted oil shale particles, heat carrier material and air into the lower portion 86 of combustor vessel 76. The ratio of the maximum cross-sectional area of combustor vessel 76 to combustor lift pipe 70 taken in a widthwise (horizontal) direction, transverse to the upward flow of air, is from 2:1 to 10:1 and preferably 5:1.

Combustion of the retorted oil shale particles is completed in combustor vessel 76. In combustor vessel 76, the retorted oil shale particles, heat carrier material and air are at a temperature from 1000° F. to 1400° F. at a residence time from 1 minute to 10 minutes, and preferably not greater than 3 minutes.

The bottom 88 of combustor vessel 76 slopes downwardly to facilitate the downward gravity flow of combusted oil shale particles and heat carrier material into the lower portion 86 of combustor vessel 76. Bottom 88 of combustor vessel 76 is welded or otherwise secured to an upper portion of combustor lift pipe 70 and has a centrally disposed, combustor lift pipe-receiving opening 90 through which the combustor lift pipe 70 extends.

The combusted oil shale particles and heat carrier material are discharged through an outlet 92 in the bottom of combustor vessel 76 and are conveyed by gravity flow through heat carrier pipe 24 into mixing chamber 20. The lower end of heat carrier pipe 24 has an L valve 94 through which a fluid, such as the lift gas, can be injected to help transport the combusted oil shale particles and heat carrier material into mixing chamber 20. In the preferred embodiment, oil shale particles that have been combusted in combustor vessel 76 provide the heat carrier material for the system. Sand can also be added as additional heat carrier material if necessary.

Combustor vessel 76 also has an overflow discharge outlet 96 at its bottom to withdraw excess combusted oil shale particles and heat carrier material that have accumulated in the bottom of the combustor vessel. Shutoff valve 98 controls the rate of withdrawal.

The carbon contained in the retorted oil shale particles is burnt off mainly as carbon dioxide during combustion in the combustor lift pipe 70 and combustor vessel 76 and together with the air and other products of combustion forms combustion gases which are contained in the upper portion 100 of combustor vessel 76 and subsequently dedusted. In the preferred embodiment, the combustion gases are dedusted by a cyclone 102 located in the interior of combustor vessel 76. Cyclone 102 has an upper inlet 104 in the upper portion 100 of combustor vessel 76 and a lower inlet 106 at the bottom of a riser pipe 108 in the lower portion 86 of combustor vessel 76. Dedusted combustion gases are discharged through combustion gas outlet 110 along the curved, concave top 112 of combustor vessel 76 to an electrostatic precipitator 114 for further dedusting. The dedusted combustion gases can be discharged to the atmosphere or processed further for energy recovery, such as to produce steam for steam injectors 48 and 49 or a steam turbine.

In the illustrated embodiment, the main body portions of the mixing chamber 20, solids-containing vessel 30 and combustor vessel 76, as well as lift pipes 28 and 70, have a circular cross-section. Other cross-sectional configurations can also be used.

In the embodiment of FIG. 2, a series of lift gas injection nozzles 126 are used in lieu of a single lift gas injector 26 to provide an even better mixing pattern in the mixing chamber. Lift gas injection nozzles 126 can be arranged to provide a spouted bed in the mixing chamber.

Among the many advantages of the above retorting process and system are:

1. Improved product yield.
2. Reduced thermal cracking of condensable hydrocarbons.
3. Greater throughput.
4. Lower retorting time.
5. Reduced downtime.
6. Avoidance of moving parts in the retorting zones.
7. Fewer repairs and malfunctions.
8. Longer useful life.
9. Greater economy.

While the apparatus described in the system is particularly useful for retorting oil shale and other solid hydrocarbon-containing materials in accordance with the above process, it may be desirable in some circumstances to use the system for catalytic cracking of oil or processing other feedstocks.

Although embodiments of this invention have been shown and described, it is to be understood that various modifications and substitutions, as well as rearrangement of parts and combination of process steps, can be made by those skilled in the art without departing from the novel spirit and scope of this invention.

What is claimed is:

1. A fluid bed system, comprising:

a generally upright lift pipe;

a first vessel in fluid communication with and located downstream and generally above said lift pipe;

an enlarged mixing chamber in fluid communication with and located upstream and generally below said lift pipe, said enlarged mixing chamber having a maximum transverse cross-sectional area substantially greater than the maximum transverse cross-sectional area of said lift pipe;

lift gas means directly connected to and communicating with said enlarged mixing chamber for injecting a lift gas into said enlarged mixing chamber, said lift gas means including combustion preventing means for preventing air and a sufficient amount of molecular oxygen to support combustion from entering said enlarged mixing chamber to substantially prevent combustion in said enlarged mixing chamber and lift pipe;

first feed means directly connected and extending into said enlarged mixing chamber for feeding a first material into said enlarged mixing chamber;

second feed means comprising combusted solid material feed means spaced separately and apart from said first feed means and directly connected and extending into said enlarged mixing chamber for feeding a second material consisting essentially of substantially combusted solid material into said enlarged mixing chamber;

combustor means spaced separately and laterally away from said enlarged mixing chamber and said lift pipe for substantially combusting carbon residue contained on said material, said combustor means including a combustor lift pipe and a second vessel comprising a combustor vessel in fluid communication with and located downstream and generally above said combustor lift pipe;

combustor feed means directly connecting and extending between said first vessel and said combustor lift pipe for discharging and feeding material containing carbon residue from said first vessel to said combustor lift pipe; and said second feed means directly connecting and extending between said combustor vessel and said enlarged mixing chamber for feeding said combusted material to said enlarged mixing chamber for use as said second material.

2. A fluid bed system in accordance with claim 1 wherein the ratio of the maximum transverse cross-sectional areas of said enlarged mixing chamber to said lift pipe is from 1.3:1 to 15:1.

3. A fluid bed system in accordance with claim 1 wherein said first vessel has a maximum transverse cross-sectional area substantially greater than the maximum transverse cross-sectional area of said lift pipe.

4. A fluid bed system in accordance with claim 3 wherein the maximum transverse cross-sectional area of said first vessel is substantially greater than the maximum transverse cross-sectional area of said enlarged mixing chamber and the ratio of the maximum transverse cross-sectional areas of said first vessel to said enlarged mixing chamber is from 2:1 to 10:1.

5. A fluid bed oil shale retorting system, comprising:

an overhead solids-containing vessel having a lower portion for retorting raw oil shale and an upper portion for containing liberated hydrocarbons and a lift gas, said lower portion having a solids discharge outlet for discharging retorted oil shale and heat carrier material consisting essentially of substantially combusted retorted oil shale and said upper portion including a gas outlet for discharging liberated hydrocarbons and said lift gas;

a mixing chamber located generally below said solids-containing vessel for mixing said raw oil shale and said combusted shale to partially retort said raw oil shale;

raw oil shale feed means connected and extending directly into said mixing chamber for feeding raw oil shale directly into said mixing chamber at a solids flux flow rate of 500 lbs/ft$^2$ hr to 100,000 lbs/ft$^2$ hr;

combusted shale feed means spaced separately and away from said raw oil shale feed means and directly connected and extending into said mixing chamber for feeding said combusted oil shale directly into said mixing chamber at a solids flux flow rate ratio relative to said raw oil shale of from 2.5:1 to 10:1 to mix with and heat said raw oil shale in said mixing chamber;

a substantially vertical lift pipe in fluid communication with and extending upwardly from said mixing chamber into said overhead solids-containing vessel;

said mixing chamber having a cross-sectional area substantially greater than the cross-sectional area of said lift pipe taken in a direction generally transverse to the upward direction of flow;

lift gas injector means spaced separately and apart from both said raw oil shale feed means and said combusted shale feed means for injecting a lift gas into said mixing chamber at a sufficient velocity to fluidize and carry said raw and combusted oil shale and said liberated hydrocarbons generally upwardly through both said mixing chamber and said vertical lift pipe into said overhead solids-containing vessel, said lift gas injector means including combustion preventing means for substantially preventing air from entering said mixing chamber to substantially prevent combustion of said raw oil shale and liberated hydrocarbons in said mixing chamber, vertical lift pipe, and overhead solids-containing vessel;

a combustor vessel spaced laterally away from said overhead solids-containing vessel, said combustor vessel having a lower portion for combusting retorted oil shale and an upper portion for containing combustion gases, said lower portion having a discharge outlet connected to said combusted shale feed means for discharging combusted shale into said combusted shale feed means, said upper portion having a combustion gas outlet;

an upright dilute phase, combustor lift pipe extending upwardly into said combustor vessel for partially combusting said retorted shale;

combustion feed means directly connected and extending between said solids discharge outlet of said overhead solids-containing vessel and said upright dilute phase, combustor lift pipe for feeding retorted shale from said solids discharge outlet of said overhead solids-containing vessel to said combustor lift pipe; and air injector means for injecting air into a bottom portion of said combustor lift pipe to substantially combust, fluidize, and carry said retorted shale generally upwardly through said combustor lift pipe into said combustor vessel.

6. A fluid bed system in accordance with claim 5 wherein the ratio of the cross-sectional areas of said mixing chamber to said vertical lift pipe is in the range from about 1.3:1 to about 15:1.

7. A fluid bed system in accordance with claim 6 wherein the ratio of the cross-sectional area of said combustor vessel to the cross-sectional area of said combustor lift pipe taken in a direction generally transverse to the upward direction of air flow is in the range from about 2:1 to about 10:1.

8. A fluid bed system in accordance with claim 5 wherein the ratio of the cross-sectional area of said mixing chamber to the cross-sectional area of said lift gas injector means is in the range from about 2.5:1 to about 20:1.

9. A fluid bed system in accordance with claim 5 wherein said overhead solids-containing vessel includes a conical baffle spaced slightly above said vertical lift pipe for directing said shale generally downwardly into the lower portion of said overhead solids-containing vessel.

10. A fluid bed system in accordance with claim 9 wherein said overhead solids-containing vessel includes an array of conical baffles arranged in an offset, staggered pattern in the lower portion of said solids-containing vessel for enhancing the downward flow and minimizing backmixing of retorted shale in said overhead solids containing vessel.

11. A fluid bed system in accordance with claim 5 further including steam injector means for injecting steam into the lower portion of said solids-containing vessel.

12. A fluid bed system in accordance with claim 5 wherein said mixing chamber includes a series of vertical bars for enhancing mixing of said raw and combusted oil shale.

13. A fluid bed system in accordance with claim 5 wherein the ratio of the height to the diameter of said mixing chamber is in the range from about 1:1 to about 10:1.

14. A fluid bed system in accordance with claim 5 wherein the ratio of the cross-sectional area of the said solids-containing vessel to the cross-sectional area of said mixing chamber is in the range of about 2:1 to about 10:1.

15. A fluid bed system in accordance with claim 5 wherein the ratio of the cross-sectional areas of said solids-containing vessel to said mixing chamber is about 5:1, the ratio of the cross-sectional areas of said mixing chamber to said vertical lift pipe is about 3:1, the ratio of the cross-sectional area of said mixing chamber to the cross-sectional area of said lift gas injector means is about 5:1, and the ratio of the cross-sectional area of said combustor vessel to said combustor lift pipe is about 5:1.

16. A fluid bed system in accordance with claim 5 further including a return pipe directly connecting and extending from the lower portion of said overhead solids-containing vessel to said mixing chamber and valve means operatively connected to said return pipe for selectively limiting flow of shale through said return pipe.

17. A fluid bed system in accordance with claim 5 wherein said lift gas injector means includes a series of lift gas injection nozzles.

* * * * *

UNITED STATES PATENT OFFICE
CERTIFICATE OF CORRECTION

Patent No. 4,511,434 Dated April 16, 1985

Inventor(s) Iacovos Vasalos

It is certified that error appears in the above-identified patent and that said Letters Patent are hereby corrected as shown below:

| Patent Column | Line | |
|---|---|---|
| 1 | 36 | after "States" add -- . -- |
| 3 | 55 | reads "know" and should read --known-- |
| 4 | 15 | reads "the" and should read --with-- |
| 10 | 18 | after "has" add --a-- |
| 10 | 19 | reads "defect" and should read --deflect-- |
| 14 | 20 | reads "solids containing" and should read --solids-containing-- |

Signed and Sealed this

Third Day of June 1986

[SEAL]

Attest:

DONALD J. QUIGG

Attesting Officer

Commissioner of Patents and Trademarks